US011332301B2

(12) United States Patent
Borel et al.

(10) Patent No.: US 11,332,301 B2
(45) Date of Patent: May 17, 2022

(54) STEM FOR TWO-WAY VALVE

(71) Applicant: LINDAL FRANCE SAS, Val de Briey (FR)

(72) Inventors: Bernard Borel, Moirans (FR); Eric Gaillard, Dieue sur Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 158 days.

(21) Appl. No.: 16/648,048

(22) PCT Filed: Sep. 18, 2018

(86) PCT No.: PCT/EP2018/075134
§ 371 (c)(1),
(2) Date: Mar. 17, 2020

(87) PCT Pub. No.: WO2019/063347
PCT Pub. Date: Apr. 4, 2019

(65) Prior Publication Data

US 2020/0255211 A1 Aug. 13, 2020

(30) Foreign Application Priority Data

Sep. 27, 2017 (FR) ..... 1758986

(51) Int. Cl.
*B65D 83/42* (2006.01)
*B65D 83/62* (2006.01)
(Continued)

(52) U.S. Cl.
CPC ..... *B65D 83/425* (2013.01); *B65D 83/62* (2013.01); *B65D 83/38* (2013.01); *B65D 83/48* (2013.01); *B65D 83/54* (2013.01); *B65D 83/682* (2013.01)

(58) Field of Classification Search
CPC ..... B65D 83/68–687; B65D 83/425; B65D 83/62; B65D 83/38; B65D 83/48;
(Continued)

(56) References Cited

U.S. PATENT DOCUMENTS 3,674,180 A * 7/1972 Morane ..... B65D 83/682 222/402.18
3,813,011 A * 5/1974 Harrison ..... B65D 83/20 222/136
(Continued)

FOREIGN PATENT DOCUMENTS

EP 3064448 A1 9/2016
FR 2961795 A1 12/2011
(Continued)

OTHER PUBLICATIONS

International Search Report and Written Opinion dated Nov. 28, 2018 issued in corresponding application No. PCT/EP2018/075134; w/ English partial translation and partial machine translation (total 24 pages).
(Continued)

*Primary Examiner* — Frederick C Nicolas
*Assistant Examiner* — Randall A Gruby
(74) *Attorney, Agent, or Firm* — Seckel IP, PLLC

(57) ABSTRACT

A stem (1) for a two-way valve has a main body (10) outer face that is substantially cylindrical about a main axis, with (i) a first tubular wall (11) closed at its lower end by a first bottom wall (13) and open at its upper end (111), defining a central channel (113); (ii) a second tubular wall (12), concentric with the first tubular wall (11) and partially surrounding it, closed at its lower end (122) by a second bottom wall (14) and open at its upper end (121), defining an annular channel (123) around the central channel (113), one or more through-
(Continued)

Figure 1:
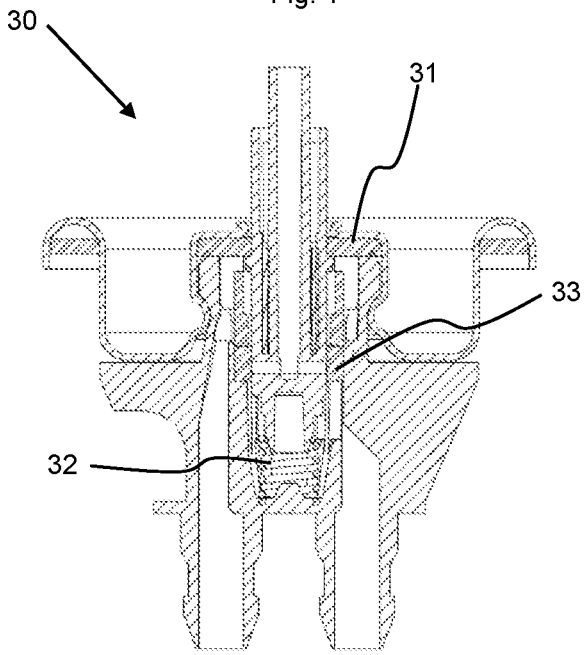

holes (124) bringing the inside of the annular channel (123) in contact with the cylindrical outer face of the main body (10); and (iii) a tubular insert (20) dimensioned so as to be able to be inserted into the annular channel (123).

20 Claims, 3 Drawing Sheets

(51) Int. Cl.
*B65D 83/38* (2006.01)
*B65D 83/48* (2006.01)
*B65D 83/54* (2006.01)
*B65D 83/68* (2006.01)

(58) Field of Classification Search
CPC . B65D 83/54; B05B 11/0078; B05B 11/0081; B65B 31/00; B65B 31/003
See application file for complete search history.

(56) References Cited

U.S. PATENT DOCUMENTS 3,982,668 A * 9/1976 Riccio ..... B65D 83/682 222/402.18
7,124,788 B2 * 10/2006 Pericard ..... B65D 83/62 141/3
7,798,366 B2 * 9/2010 Hoshino ..... B65D 83/682 222/136
8,317,062 B2 * 11/2012 Bodet ..... B65D 83/425 222/95
8,505,775 B2 * 8/2013 Bodet ..... B65D 83/682 222/95
9,096,371 B2 * 8/2015 Allsop ..... B65D 83/425
9,446,895 B2 * 9/2016 Mekata ..... B65D 83/384
9,624,021 B2 * 4/2017 Bodet ..... B65D 83/682
10,071,850 B2 * 9/2018 Sugawara ..... B65D 83/7532
10,160,592 B2 * 12/2018 Sugawara ..... B65D 83/38
2003/0024953 A1 * 2/2003 Peter Lilienthal ..... B65D 83/66 222/402.1
2003/0089739 A1 * 5/2003 O'Connor ..... B65D 83/64 222/145.5
2004/0056054 A1 * 3/2004 Ottolangui ..... A61M 15/009 222/544
2004/0226964 A1 * 11/2004 Bourque ..... B65D 83/68 222/136
2013/0092710 A1 4/2013 Bodet et al.
2013/0168413 A1 7/2013 Bodet et al.
2016/0280449 A1 9/2016 Mekata et al.
2021/0002064 A1 * 1/2021 Tsubouchi ..... B65D 83/752
2021/0107727 A1 * 4/2021 Borel ..... B65D 83/44

FOREIGN PATENT DOCUMENTS

JP 2013537503 A 10/2013
JP 2014237460 A 12/2014
WO 2012022685 A1 2/2012
WO 2015064717 A1 3/2017

OTHER PUBLICATIONS

Indian Office Action dated Oct. 12, 2021 in counterpart application No. IN 202027012645; in English (total 5 pages).

* cited by examiner

A-A

B-B

C-C

B-B

C-C

STEM FOR TWO-WAY VALVE

The invention relates to a valve rod (more commonly known as a stem) for a two-way valve. The stem comprises a main body having an outer face that is substantially cylindrical about a main axis. It has:

- a first tubular wall closed at its lower end by a first bottom wall and open at its upper end, defining a central channel;
- a second tubular wall concentric with the first tubular wall and partially surrounding it, the second tubular wall being closed at its lower end by a second bottom wall and open at its upper end, defining an annular channel placed around the central channel, one or more through-holes bringing the inside of the annular channel in contact with the cylindrical outer face of the main body; and
- means for reinforcing the first tubular wall to improve its stability when filling a container provided with a two-way valve equipped with the stem.

This kind of stem is commonly used in two-way valves to maintain the separation of the products until they leave the valve, or even until they leave the diffuser. To save material, the annular channel is much deeper than necessary and extends down to near the through-holes that bring the bottom of the central channel in contact with the outside of the stem. To fill the pouches attached to the valve, it is common, when the product is not too thick, to introduce the product via the valve maintained in the open position. The filling head is placed in a sealed manner at the top of the central or annular channel by opening the valve, and the product is pumped into the pouch. However, it has been observed that the central wall could be torn off during this filling operation. To remedy this problem, it has become customary to place reinforcement ribs, generally three, at the bottom of the annular channel. These ribs extend from the bottom of the annular channel up to near the through-holes of this annular channel. Thus, dead spaces are formed, in which the product leaving via the second path enters. In addition, the volume of the annular channel, above the through-holes, is relatively large. This dead volume then quickly fills with soiled product.

The objective of the invention is to remedy this drawback.

This objective can be achieved by designing the reinforcing means in the form of means intended to fill at least partially the section of the annular channel located between the second bottom wall and the lower portion of the through-hole or -holes of the second tubular wall.

A first variant embodiment consists in filling at least partially the space of the annular channel located below the through-holes with material constituting the stem. However, in addition to the fact that this solution requires more material and therefore makes stems more expensive, it has the drawback that, with certain materials, during cooling, the material can shrink too much, as a result of which a tight seal with the sealing ring used to close the through-holes of the central channel can no longer be guaranteed.

In a second variant embodiment according to the invention, the reinforcing means are constituted by a tubular insert dimensioned to be able to be inserted into the annular channel and fill, at least over a portion of its height, the space located between the second bottom wall and the lower portion of the through-hole or -holes of the second tubular wall. This insert is dimensioned to support the first tubular wall during filling.

Thus, this insert occupies at least a portion of the space located below the through-holes of the annular channel. This space can no longer be occupied by the product.

Concretely, the insert can have a tubular shape forming a third tubular wall whose transverse cross-section has an inner contour that corresponds substantially to the outer contour of the transverse cross-section of the first tubular wall and an outer contour that corresponds substantially to the inner contour of the transverse cross-section of the second tubular wall, when the insert is located in the annular channel in the use position. Generally, the contours are circular. In this case, the inner diameter of the third tubular wall corresponds substantially to the outer diameter of the first tubular wall and its outer diameter to the inner diameter of the second tubular wall.

In a first, simple embodiment of this second variant embodiment, the height of the insert is less than or equal to the distance separating the second bottom wall and the lower end of the through-hole or -holes of the second tubular wall. Thus, this insert occupies only the lower portion of the annular channel, below the through-holes.

In a second embodiment, the height of the insert is greater than the distance separating the second bottom wall and the lower end of the through-holes of the second tubular wall, preferably the distance separating the second bottom wall and the upper end of the through-holes. For this, the insert is provided with at least one slot extending from a slot bottom to an open upper end located at the level of the upper end of the third tubular wall. The distance between the slot bottom and the lower end of the third tubular wall is selected so that, when the insert is located in the annular channel in the use position, at least one through-hole opens fully into the slot or slots. The slot or slots can pass through the entire thickness of the third tubular wall.

One or more sets of through-holes can pass through the second tubular wall, each set of through-holes being constituted by at least one pair of through-holes, preferably of the same diameter, placed side by side in a same plane perpendicular to the main axis. When the insert is provided with slots and the central channel with sets of through-holes, the width of each slot at the level of the through-holes is equal to or greater than the distance separating the outer edges of the two most distant through-holes in a same set of through-holes.

If the insert extends above the through-holes of the annular channel, it is preferable to provide indexing means to align the slot or at least one of the slots of the insert with a set of through-holes in the second tubular wall.

One or more through-holes are generally provided to bring the inside of the central channel in contact with the cylindrical outer face of the main body without passing through the annular channel, the through-holes of the second tubular wall opening onto the cylindrical outer face of the main body, preferably between the through-holes of the first tubular wall and the upper end of the second tubular wall.

In order to guide the stem in the valve and fix the spring that maintains it in the closed position, it is preferable to provide the lower end of the main body with a tenon for cooperation with a spring in the valve. It is also possible to provide the cylindrical outer face of the main body with an annular shoulder positioned so that the through-hole or -holes of the second tubular wall are located between this shoulder and the upper end of the second tubular wall.

Figure 2:
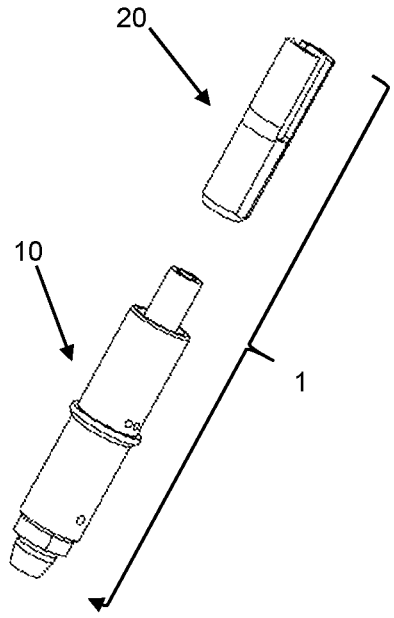
Figure 3:
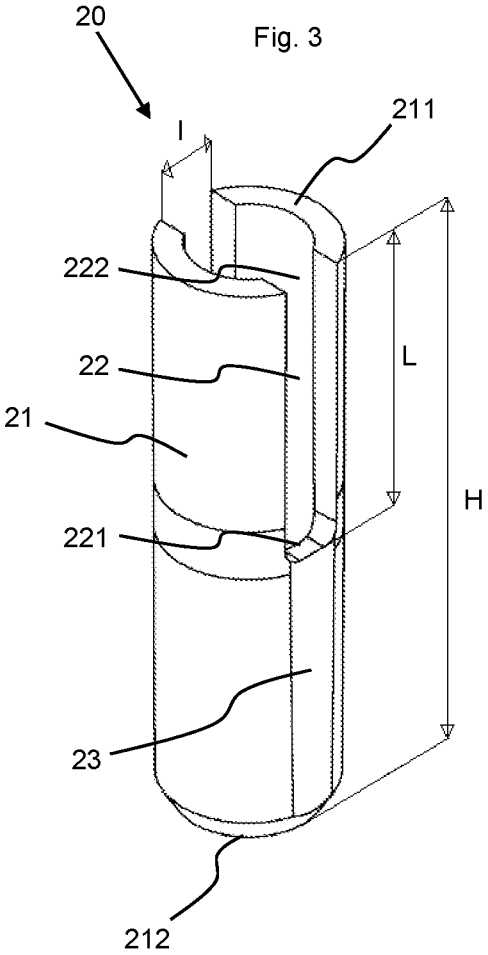
Figure 5:
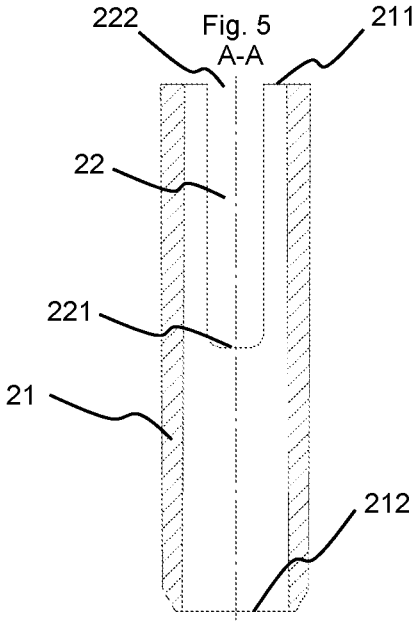
Figure 4:
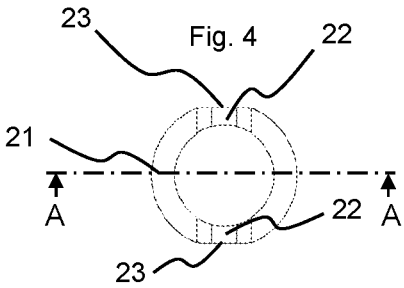
Figure 6:
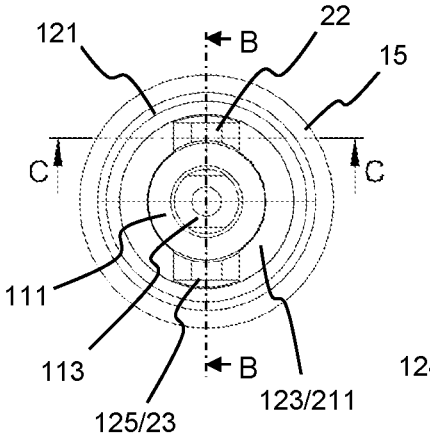
Figure 7:
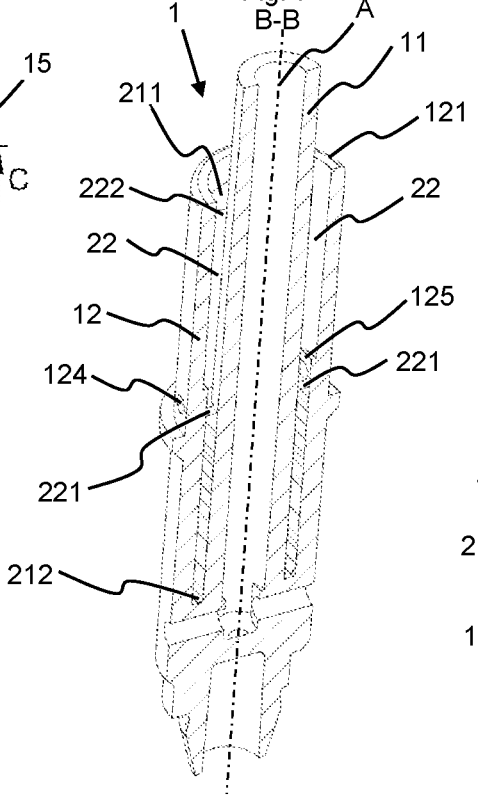
Figure 8:
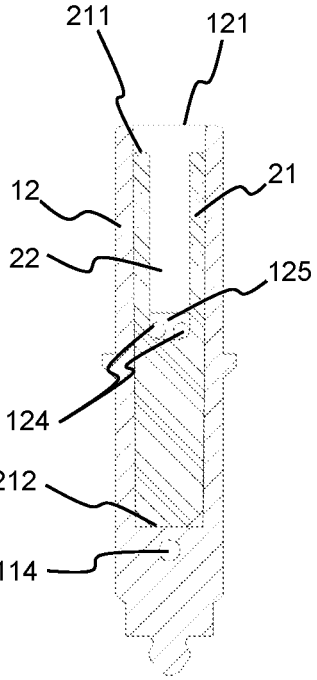
Figure 9:
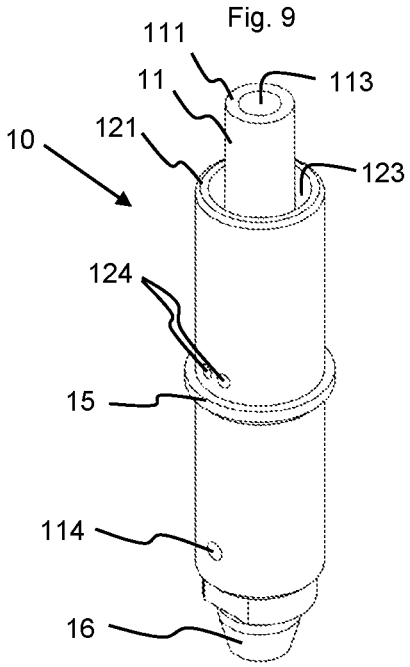
Figure 10:
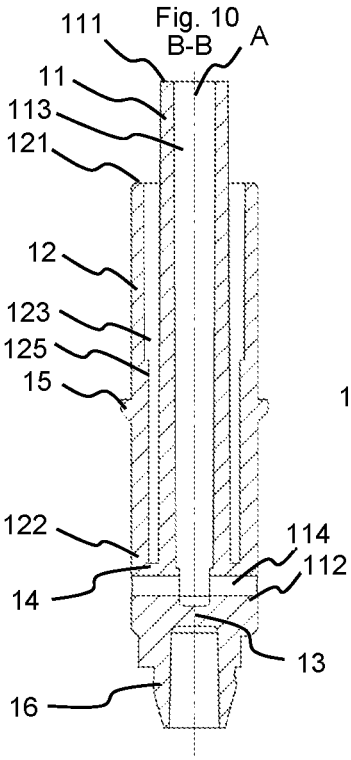
Figure 11:
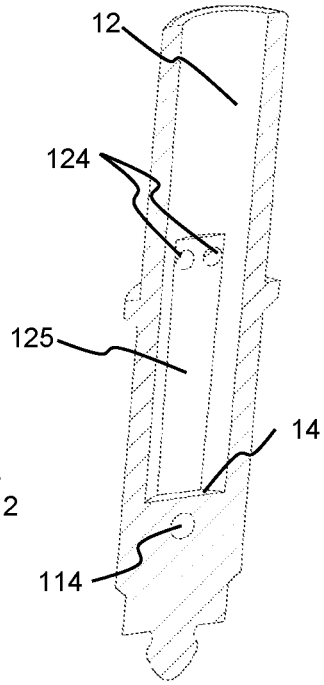
Figure 12:
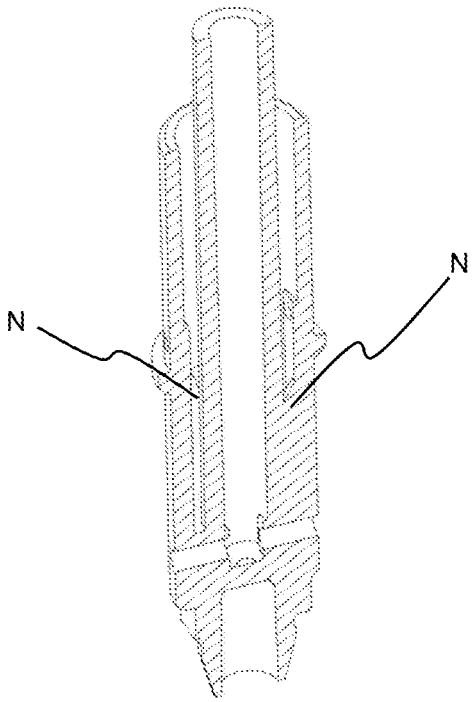
Figure 13:
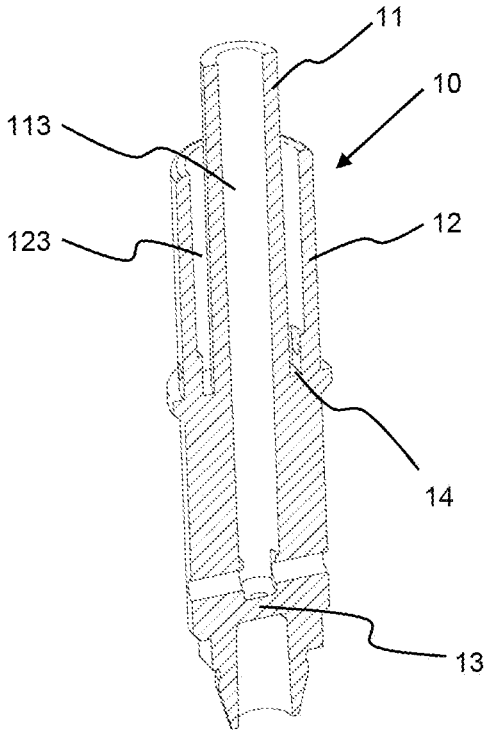

The invention is explained in more details below using the figures, which show:

FIG. 1 Cross-sectional view of a two-way valve provided with a stem of the invention, along a plane passing through a main axis passing through the stem;

FIG. 2 Exploded view of the stem of the invention constituted by a main body and a reinforcement insert;

FIG. 3 Perspective view of the insert;

FIG. 4 Top view of the insert;

FIG. 5 Cross-sectional view of the insert along a plane A-A shown on FIG 4;

FIG. 6 Top view of the stem of the invention;

FIG. 7 Cross-sectional view of the stem of the invention along a plane B-B shown on FIG 6;

FIG. 8 Another cross-sectional view of the stem of the invention along a plane C-C shown on FIG 6;

FIG. 9 Perspective view of the main body;

FIG. 10 Cross-sectional view of the main body along the plane B-B shown on FIG 6;

FIG. 11 Another cross-sectional view of the main body along the plane C-C shown on FIG 6;

FIG. 12 Cross-sectional view of a stem of the state of the art with reinforcing ribs along a plane corresponding to plane B-B shown on FIG 6;

FIG. 13 Cross-sectional view of another stem according to the invention with reinforcement filling along a plane corresponding to a plane C-C shown on FIG 6.

The invention relates to a valve rod for a two-way valve used in pressurized containers. Such valve rods are commonly called stems.

The stems (1) for two-way valves used for the invention are of the kind having concentric paths. They have an outer shape that is generally cylindrical about a main axis (A).

The stem is intended to be used in a two-way valve (30) having parallel pouches like the one shown by way of example in FIG. 1, or having concentric pouches (bag-in-bag), or else having concentric containers (for example, with double piston). The stem and its components usually have a certain rotational symmetry about a main axis (A) passing through the stem. It will be seen that this rotational symmetry is not absolute, as some portions of the stem deviate from it. The adjectives "axial" or "radial" refer to this main axis and define an element parallel to the axis or perpendicular to this axis, respectively. To simplify the description, the spatial references such as "upper" and "lower" refer to the stem and its components as shown in FIG. 1 or FIG. 7, for example. These are not absolute positions, as the valve in which the stem of the invention is mounted can be used upwards (as in FIG. 1), downwards, or more generally in any position adapted to the product that must be delivered.

The stem of the invention has a main body (10) and an insert (20). The main body includes a first central tubular wall (11) partially surrounded by a second tubular wall (12). These two walls are preferably substantially cylindrical. In practice, they can deviate almost imperceptibly from an absolutely cylindrical shape, in order to facilitate demolding.

The first tubular wall (11) is open at its upper end (111) and closed at its lower end (112) by a bottom wall (13), which is preferably radial. This first tubular wall (11) and the bottom wall (13) define a space in the shape of a central channel (113). Two through-holes (114) are made in the main body (10), near the lower end (112) of the central channel (113). Each of these through-holes (114) connects the inside of the central channel (113) and the cylindrical outer face of the main body (10). The central channel (113) and the through-holes (114) constitute the first path of the stem (1).

The second tubular wall (12) surrounds the first tubular wall (11) concentrically. It (12) is open at its upper end (121) and closed at its lower end (122) by a second bottom wall (14), which is preferably radial. The second tubular wall (12) and the second bottom wall (14) define a space in the shape of an annular channel (123). The second bottom wall (14) is located between the first through-holes (114) and the upper end (121) of the second tubular wall (12), so that the first through-holes (114) do not pass through the annular channel (123). Two pairs of two through-holes (124) are made in the second tubular wall (12), at a distance from the upper end (121) and from the second wall (14). Each of these second through-holes (124) connects the inside of the annular channel (123) and the cylindrical outer face of the main body (1). The annular channel (123) and the second through-holes (124) form the second path of the stem (1).

Below the second through-holes (124), the main body has on its outer face an annular shoulder (15) which serves to retain the stem in the valve body when it is mounted in a valve. The upper face of this shoulder is radial and comes to bear against a first annular seal (31) of the valve which serves to close the second through-holes (124) when the valve is in the closed position. The lower face of the shoulder can be slanted.

The outer face of the first tubular wall (11) widens starting from the lower end (122) of the second tubular wall (12) to come into alignment with the outer face of the latter so that the outer envelope of the main body (10) remains uniform from the annular shoulder (15) to below the first through-holes (114). It can be considered that the second bottom wall (14) is part of the outer face of the first tubular wall (11) at the level where it widens to come into alignment with the second tubular wall (12).

The inner face of the second tubular wall (12) is cylindrical in its upper portion. However, two vertical flat portions (125) extend from the bottom of the annular channel (123) up to above the second through-holes (124) as can be seen in FIG. 11. It is not essential that these flat portions extend up to above the second through-holes (124); they could stop lower. Their width is equal to or slightly greater than the distance separating the two opposite ends of two through-holes (124) of a same pair of second through-holes. The vertical radial plane of symmetry of each flat portion (125) is identical to the vertical radial plane of symmetry passing between two through-holes (124) of the same pair. The flat portions (125) must not be too large, in order to always leave sufficient space between their vertical face and the outer face of the first tubular wall (11).

The lower end of the main body (10) is provided with a tenon (16) serving to support a spring (32) of the valve.

The objective of the invention is to remove the ribs (N) that are usually present in the lower portion of the annular canal (see FIG. 12), in order to avoid dead volumes in which the product can stagnate. But purely and simply removing these ribs weakens the main body and in particular the first tubular wall (11), which risks breaking during filling.

A first variant embodiment consists in removing at least partially the section of the annular channel (123) located below the second through-holes (124), replacing it with material used for the manufacture of the main body, as shown on FIG. 13. It can be seen that, in this case, the stem consists only of the main body. In its upper portion, the main body is constituted by two concentric cylindrical walls (11, 12) extending up to below the second through-holes (124), then these two walls join to form a single cylindrical wall having a thickness substantially equal to the combined thickness of the first tubular wall (11), the annular channel (123) and the second tubular wall (12). It can also be considered that the upper face of the second radial bottom wall (14) is located near, but below, the second through-holes (124), whereas it is usually located just above the first through-holes (114). This section of the annular channel can be filled up to the immediate proximity of the second through-holes, or even up to being flush with them, or simply up to an intermediate height corresponding for example to the height of the traditional radial ribs (N). This solution, although it is more expensive in material than the traditional radial ribs, makes it possible to support the first tubular wall (11) better than with the ribs, and to do this while retaining the same outer shape of the main body. Materials must be selected which, despite the increased thickness in the lower portion of the main body, do not shrink significantly during cooling after molding, in order to avoid potential risks of leakage at the level of the lower seal of the valve (the seal that ensure sealing at the level of the first through-holes (114) of the first path).

Another alternative embodiment consists in placing an insert in the lower portion of the annular channel (123) (see FIG. 7), rather than filling it. This tubular insert (20) is constituted by a third tubular wall (21) open at its two ends.

The inner diameter of the third tubular wall (21) corresponds substantially to the outer diameter of the first tubular wall (11) and its outer diameter to that of the inner diameter of the second tubular wall (12). It is preferable that the portion of the insert located below the second through-holes (124) is slightly oversized relative to the space available so that it is necessary to insert it into the annular channel (123) by force. In other words, its inner diameter will be slightly smaller than the outer diameter of the first tubular wall (11) and/or its outer diameter will be slightly larger than the inner diameter of the second tubular wall (12). This ensures that the insert will not move when the valve is used. It also prevents the product from entering the gap between the insert and the walls of the annular channel (123) in the portion located below the second through-holes. Lastly, the insert contributes to improving the stability of the stem and in particular of its first tubular wall (11). This insert has the advantage over filling the space with material as mentioned with reference to FIG. 13 that it does not pose a problem of excessive retraction of the material during cooling of the main body after molding. Indeed, the second tubular wall (12) extends on both sides of the second through-holes (124) with a same thickness, except in the area of the shoulder (15).

The height (H) of the insert is less than or equal to the height of the annular channel (123). It is inserted into the annular channel until it touches the second bottom wall (14) as can be seen in FIG. 7.

In a simple embodiment not shown, the height (H) of the insert is less than or equal to the distance separating the bottom of the second through-holes (124) and the second bottom wall (14). In practice, this height will be selected so that the upper end of the insert comes as close as possible to the through-holes (124), but without ever encroaching on them. It would however be possible to select a smaller height, like that of the usual reinforcing ribs (N) of traditional stems (cf. FIG. 12).

In a preferred embodiment of the invention, the height (H) of the insert is greater than the distance separating the second bottom wall (14) and the top of the through-holes (124). In this case, it is necessary to provide vertical slots (22) extending axially from a bottom (221) to an open upper end (222) located at the level of the upper end (211) of the cylindrical wall. The slots preferably pass through the entire thickness of the cylindrical wall (21). The width (1) of the slots is greater than or equal to the distance separating the outer ends of two through-holes (124) of a same pair (see FIG. 8). In practice, it does not need to be greater than this distance. For reasons of simplicity, the bottom (221) is flat with angles forming an arcuate portion of the same radius as the second through-holes (124), as can be seen in FIG. 8. The length (L) of the slot, from the lower end of the bottom (221) to its upper end (222), is selected so that, depending on the geometry of the bottom, the through-holes (124) open entirely into the slots, without the third tubular wall (21) encroaching on the through-holes (124). These slots (22) constitute flow channels for the product, thereby limiting the space available and the volume of product that stagnates after filling and after each use.

Each slot (22) is continued, on the outer face of the insert, by a flat portion (23) of the same width. The width of the flat portions (23) of the insert is substantially identical to the width of the flat portions (125) of the inner face of the second tubular wall (12). It is therefore understood that these complementary flat portions (125/23) are used to align slots (22) on the pairs of through-holes (124). When the inserts have a height (H) smaller than the distance between the second wall (14) and the through-holes (124), the angular orientation of the insert relative to the main body is not important, and it is possible to do without the flat portions (125) of the second channel (123) and the flat portions of the insert.

In order to facilitate insertion of the insert into the annular channel (123), the lower end (212) of the insert can be chamfered.

The main body is preferably made of a rigid material, for example polyoxymethylene (POM), poly(butylene terephthalate) (PBT), or polyamide (PA). For the insert, a softer material such as polyethylene or polypropylene will preferably be selected. In general, the material chosen for the insert is softer than that used for the main body, so that the first is deformed without the second being damaged during insertion of the insert into the main body by force.

The insert of the invention has several advantages. First of all, it provides a reinforcement function that makes it possible to stabilize the first tubular wall (11) when filling the product into the container provided with a valve equipped with the stem of the invention. Next, it avoids or at least reduces the dead spaces between the through-holes (124) and the second bottom wall (14), dead spaces in which the product can stagnate. Lastly, when the insert protrudes above the through-holes (124), it limits the space available for the product.

The exemplary embodiment presented here is not limiting. Other alternative embodiments are possible:

The number of through-holes (114, 124) depends on the desired flow rate and/or the viscosity of the product to be dispensed.

(i) Regarding the second path, a single pair of through-holes (124) could be provided, or more than two pairs. Rather than a pair of holes, sets of more than two holes could be provided, for example three holes, placed side by side in the same horizontal radial plane. The advantage of choosing sets of at least two holes rather than a single hole of the same cross-section lies in the fact that the corresponding diameter of the holes in the set is smaller. This implies that the height of the seal (31) required in order to close the set of through-holes (124), and therefore, the stroke of the stem required in order to open the valve, is less than that necessary to close a single hole having the same surface but a larger diameter. Instead of a pair of holes, a single oblong or oval hole could be provided, whose height would be less than its width. A single hole could also be provided several times, like for the first through-holes (114).

(ii) Regarding the first path, a single hole could be provided, or more than two holes. In particular, sets of holes, or oblong or oval holes, could be provided, like for the second path.

The holes are preferably arranged radially. However, they could be oriented differently and in particular be slanted.

If the insert stops before the second through-holes (124), it is not necessary to orient it according to a particular angular position relative to the main body (10) and to the second through-holes (124). Therefore, it is possible to do without the flat portions (125, 23). In contrast, if the insert extends up to above the second through-holes (124), it is necessary to align the slots (22), generally their bottoms (221), with the corresponding through-holes (124) so that the through-holes open into the slots (22) without hindrance. It is therefore necessary to be able to orient the insert relative to the main body (10). For this, one can use indexing, for example alignment means. In the example presented here, these alignment means are constituted by flat portions (125, 23) made on the inner face of the second tubular wall (12) and on the outer face of the insert. These flat portions are plumb with the through-holes. Only one pair of flat portions could have been provided, or it could have been provided not to align the flat portion or portions with the through-holes. The flat portions could also have been replaced by other alignment means, for example one or more ribs/grooves combinations.

In the example presented here, the slots (22) pass through the entire thickness of the third tubular wall (21). However, it could be envisioned that they extend only on the outer face of the insert, only digging a groove in a portion of the thickness of the wall. It could also be provided that the slots or the grooves are not straight and constant, but that they have a transverse cross-section that varies, in particular widens, or else that they are not straight and vertical, but that they have another shape, for example helical. To avoid having to orient the insert on the second through-holes (124), and thus, to be able to avoid the indexing means (for example, the flat portions), it would also be possible to provide a circular groove on the outside of the insert, at a distance from the lower edge (212) equal to the distance separating the bottom of the annular channel (14) from the second through-holes (124). When such an insert is inserted into the annular channel (123), the circular groove is located facing the through-holes (124). One or more slots or grooves are then provided in the insert or on its outer face, which extend from the circular groove to the upper end (211) of the insert.

Here, the bottom (221) of the slots (22) is flat with rounded angles. Alternatively, it could be in the form of an arcuate portion, or it could have two arcuate portions of the same diameter as the corresponding through-holes (124).

The number of slots (22) corresponds to the number of sets of two through-holes (124) of the second tubular wall (12). However, the number of sets of through-holes could be different from the number of slots. For example, for the same main body with several sets of through-holes (124), several different inserts could be provided, one with a single slot allowing only one set to be free, others with several slots allowing several sets to be free, or with as many slots as there are sets of through-holes. Another alternative would be to provide a single type of insert with several slots (22), and different main bodies, with only one set of through-holes, with several sets of through-holes, or with as many sets of through-holes as there are slots. This makes it possible to vary the flow rate of the product leaving by the second path, as compared to the flow rate of the product leaving by the first path.

LIST OF REFERENCES

1 Stem
10 Main body
11 First tubular wall
111 Upper end
112 Lower end
113 Central channel
114 Through-holes
12 Second tubular wall
121 Upper end
122 Lower end
123 Annular channel
124 Through-holes
125 Flat portions
13 1st radial bottom wall
14 2nd radial bottom wall
15 Shoulder
16 Tenon
20 Insert
21 Third tubular wall
211 Upper end
212 Lower end
22 Vertical slots
221 Slot bottom
222 Open upper end
23 Flat portions
30 Valve
31 1st annular seal
32 Spring
33 2nd annular seal
A Main axis
H Height of insert
l Width of insert slots
L Length of insert slots
N Reinforcement ribs of traditional stems

The invention claimed is:

1. A stem for a two-way valve, the stem comprising a main body having an outer face that is substantially cylindrical about a main axis and having a first tubular wall closed at a lower end of the first tubular wall by a first bottom wall and open at an upper end of the first tubular wall, the first tubular wall defining a central channel a second tubular wall concentric with the first tubular wall and partially surrounding the first tubular wall, the second tubular wall being closed at a lower end of the second tubular wall by a second bottom wall and open at an upper end of the second tubular wall, the second tubular wall defining an annular channel placed around the central channel, and the second tubular wall defining one or more through-holes bringing an inside of the annular channel in contact with the substantially cylindrical outer face of the main body, means for reinforcing the first tubular wall to increase a stability of the first tubular wall when filling of a container provided with a two-way valve equipped with the stem, wherein the reinforcing means comprise a tubular insert dimensioned to be able to be inserted into the annular channel and fill, at least over a portion of a height of the annular channel, a space between the second bottom wall and a lower portion of the through-hole or -holes of the second tubular wall.

2. The stem according to claim 1, wherein the insert has a tubular shape forming a third tubular wall whose transverse cross-section has an inner contour that corresponds substantially to an outer contour of a transverse cross-section of the first tubular wall and an outer contour that corresponds substantially to an inner contour of a transverse cross-section of the second tubular wall, when the insert is located in the annular channel.

3. The stem according to claim 2, wherein a height of the insert is greater than a distance separating the second bottom wall and a lower end of the through hole or -holes of the second tubular wall, the insert being provided with at least one slot extending from a slot bottom up to an open upper end located at the level of an upper end of the third tubular wall, the distance between the slot bottom and a lower end of the third tubular wall being selected so that, when the insert is located in the annular channel, at least one through-hole fully opens into the slot or slots.

4. The stem according to claim 3, wherein the slot or slots pass through an entire thickness of the third tubular wall.

5. The stem according to claim 4, wherein the one or more through-holes are a plurality of through-holes including one or more sets of through-holes passing through the second tubular wall, the set or each of the sets of through-holes being constituted by at least one pair of through-holes placed side by side in a same plane perpendicular to the main axis, and wherein a width of each slot at the level of the through-holes is equal to or greater than a distance separating the outer edges of the two most distant through-holes in a same set of through-holes.

6. The stem according to claim 5, wherein indexing means are provided to align the slot or at least one of the slots of the insert on the set or each of the sets of through-holes of the second tubular wall.

7. The stem according to claim 3, wherein the one or more through-holes are a plurality of through including one or more sets of through-holes passing through the second tubular wall, the set or each of the sets of through-holes being constituted by at least one pair of through-holes placed side by side in a same plane perpendicular to the main axis, and wherein a width of each slot at the level of the through-holes is equal to or greater than a distance separating the outer edges of the two most distant through-holes in a same set of through-holes.

8. The stem according to claim 7, wherein indexing means are provided to align the slot or at least one of the slots of the insert on the set or one of the sets of through-holes of the second tubular wall.

9. The stem according to claim 3, wherein a height of the insert is greater than a distance between the second bottom wall and an upper end of the through-hole or holes.

10. The stem according to claim 9, wherein the slot or slots pass through an entire thickness of the third tubular wall.

11. The stem according to claim 2, wherein a height of the insert is less than or equal to a distance separating the second bottom wall and a lower end of the through-hole or -holes of the second tubular wall.

12. The stem according to claim 2, wherein one or more through-holes are provided to bring an inside of the central channel in contact with the cylindrical outer face of the main body without passing through the annular channel.

13. The stem according to claim 1, wherein a height of the insert is less than or equal to a distance separating the second bottom wall and a lower end of the through-hole or -holes of the second tubular wall.

14. The stem according to claim 13, wherein one or more through-holes provided to bring an inside of the central channel in contact with the cylindrical outer face of the main body without passing through the annular channel.

15. The stem according to claim 1, wherein the one or more throuh-holes are a plurality of through-holes including one or more sets of through-holes passing through the second tubular wall, set the set or each of the sets of through-holes being constituted by at least one pair of through-holes placed side by side in a same plane perpendicular to the main axis.

16. The stem according to claim 15, wherein the set or each of the sets of through-holes is constituted by at least one pair of through-holes having a same diameter.

17. The stem according to claim 1, wherein one or more through-holes are provided to bring an inside of the central channel in contact with the cylindrical outer face of the main body without passing through the annular channel.

18. The stem according to claim 17, wherein the through-holes of the second tubular wall open onto the cylindrical outer face of the main body between the through-holes of the first tubular wall and the upper end of the second tubular wall.

19. The stem according to claim 1, wherein the lower end of the main body is provided with a tenon adapted to cooperate with a spring in the valve.

20. The stem according to claim 19, wherein the cylindrical outer face of the main body is provided with an annular shoulder positioned so that the through-hole or -holes of the second tubular wall are located between the annular shoulder and the upper end of the second tubular wall.

* * * * *